United States Patent [19]

Bocci et al.

[11] 4,451,230

[45] May 29, 1984

[54] RADIANT FLAT FLAME BURNER

[75] Inventors: Giorgio Bocci; Alberto Dardano, both of Genoa; Vittorio Levaggi, Chiavari; Ambrogio Milani, Ostia, all of Italy

[73] Assignee: Italimpianti Societa Impianti p.A., Genoa, Italy

[21] Appl. No.: 268,649

[22] Filed: May 29, 1981

[30] Foreign Application Priority Data

Jun. 6, 1980 [IT] Italy ..... 12561 A/80

[51] Int. Cl.[3] ..... F23Q 9/00

[52] U.S. Cl. ..... 431/284; 431/183; 431/186; 431/189; 431/354

[58] Field of Search ..... 431/183, 186, 189, 187, 431/284, 348, 354; 239/399, 403, 404, 405, 406, 427; 48/180 C, 180 M, 180 S, 180 B, 180 F

[56] References Cited

U.S. PATENT DOCUMENTS

| | | | |
|---|---|---|---|
| 1,684,480 | 9/1928 | Evans | 48/184 B |
| 2,941,585 | 6/1960 | Loebel et al. | 431/186 X |
| 3,163,203 | 12/1964 | Ihlenfield | 431/284 X |
| 3,458,997 | 8/1969 | Clark | 431/189 X |
| 3,768,962 | 10/1973 | Baranowski | 431/354 X |
| 3,836,315 | 9/1974 | Shular | 431/185 X |
| 4,013,395 | 3/1977 | Wormser | 431/353 X |
| 4,195,779 | 4/1980 | Auclair et al. | 431/183 X |
| 4,203,717 | 5/1980 | Facco et al. | 431/182 |
| 4,220,444 | 9/1980 | Reed et al. | 431/183 X |
| 4,221,558 | 9/1980 | Santisi | 431/183 |

FOREIGN PATENT DOCUMENTS

| | | | |
|---|---|---|---|
| 1540615 | 8/1968 | France | 431/183 |

*Primary Examiner*—Samuel Scott
*Assistant Examiner*—Randall L. Green
*Attorney, Agent, or Firm*—Berman, Aisenberg & Platt

[57] ABSTRACT

The invention has for its object a radiant flat flame burner used particularly in reheating furnaces for siderurgical purposes, which comprises in combination:

a combustion air swirling device consisting of fixed flat blades, fitted in the combustion air annular duct, and adapted for imparting to the combustion air a swirling motion;

a fire port of ceramic material, composed of a substantially cylindrical rear portion and of an adjoined flaring fore portion, delimited by a wall having a profile in form of a sector of a circle and extending over an angle of 90°;

a liquid fuel atomizing nozzle, the liquid fuel atomizing nozzle being provided with a swirling device, which is adapted for imparting a swirling motion to the atomized liquid fuel.

10 Claims, 5 Drawing Figures

RADIANT FLAT FLAME BURNER

SUMMARY OF THE INVENTION

The present invention has for its object a radiant flat flame burner used particularly in reheating furnaces for siderurgical purposes.

The object of the present invention is to improve the operation of the known radiant burners and particularly to improve their operation with fuel oil, by eliminating the relative mechanical fragility and the delicate servicing of the lance for delivery and atomization of the liquid fuel, and by reducing the relatively high consumption of the auxiliary atomizing fluid.

This object is attained by the invention with a radiant burner presenting, either separately or in any desired combination, the following characteristic features:

a combustion air swirling device preferably consisting of fixed flat blades, which is fitted in a combustion air annular duct, and which is adapted for imparting to the combustion air a swirling motion;

a fire port of ceramic material, and composed of a substantially cylindrical rear portion and of an adjoined flaring fore portion, preferably delimited by a wall having a profile in form of a sector of a circle and extending, for example, over an angle of 90°;

a gas fuel injection nozzle and/or a liquid fuel atomizing nozzle, the liquid fuel atomizing nozzle being provided with a swirling device, which is adapted for imparting a swirling motion to the atomized liquid fuel.

BRIEF DESCRIPTION OF THE DRAWINGS

The above and other characteristic features of the invention and the advantages deriving therefrom will appear evident from the following specification of a preferred embodiment thereof, which is diagrammatically shown by way of a non-limiting example in the accompanying drawings, in which.

DESCRIPTION OF THE PREFERRED EMBODIMENT

Figure 1:
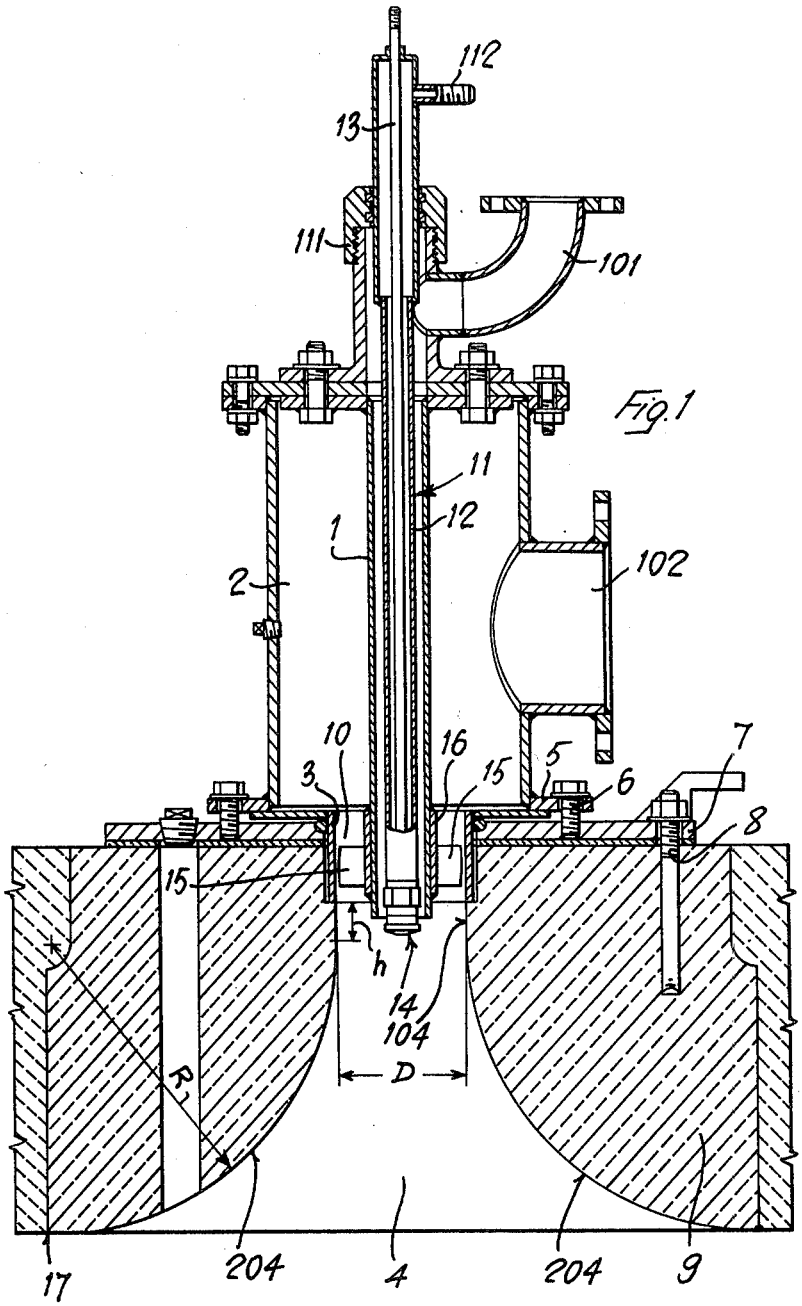
FIG. 1 shows a longitudinal section through a radiant burner according to the invention.

The radiant or flat flame burner shown in FIG. 1 is a burner of the type illustrated in U.S. Pat. No. 4,203,717 (FACCO et al.) that is to say, a radiant burner which can be operated alternatively with liquid or gas fuel, or with a mixed feed operation.

However, it should be appreciated that the invention is not limited to the above mentioned type of burners, and that all the features of the invention are applicable also to burners only for gas fuels or only for liquid fuels.

The burner consists of a duct 1 for the gas fuel, which is fed through the intake opening 101. Duct 1 is tightly passed through a hollow body or box 2 and through an adjoining cylindrical tubular boss 3 fitted in the burner fire port 4.

The combustion air, preferably pre-heated, is supplied to box 2 through the inlet port 102. Box 2 is attached, for example by means of flange 5 and bolts 6, and also by means of plate 7 and studs 8, or in any other suitable way, to the ceramic block 9 in which the burner fire port 4 is formed. The gas fuel duct 1 is coaxially fitted in the tubular boss 3 and may project slightly from said boss 3 into the burner fire port 4. The combustion air penetrates into the fire port 4 through the annular conduit 10 formed in the tubular boss 3 all around the gas fuel duct 1. Within the gas fuel duct 1, coaxially thereto, there extends the lance 11 for delivering and atomizing the liquid fuel, which may, for example, be fuel oil. The said lance 11 comprises an outer duct 12 for the atomizing fluid, such as air or steam, which is fed under pressure through the connection 112. Inside the outer duct 12 of lance 11 there extends a coaxial inner duct 13 which is connected to the liquid fuel supply. The lance 11 is passed in a tight manner into box 2 through union 111, and terminates with a liquid fuel atomizing nozzle 14 which might project slightly from the gas fuel duct 1 and/or from the tubular boss 3. The end of the gas fuel duct 1 might be just left open, or might be provided with any kind of gas fuel injection nozzles, well known to those skilled in the art.

Figure 2:
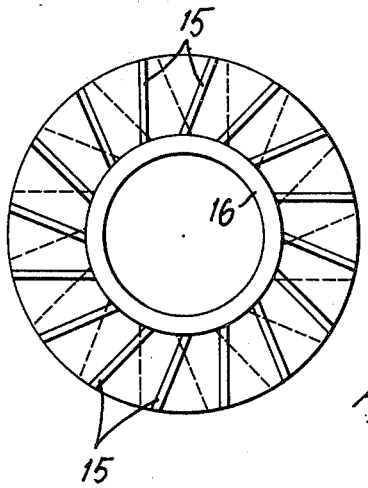
FIGS. 2 and 3 are a plan view and a side elevational view of the combustion air swirling device provided with blades.
Figure 3:
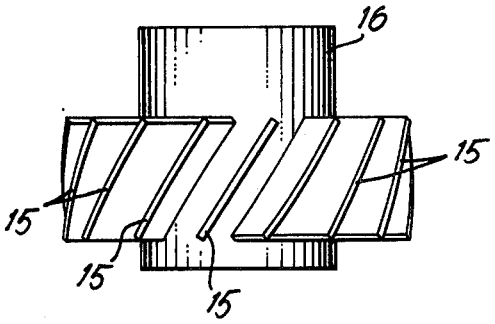

At the interior of the combustion air annular conduit 10, in the tubular boss 3 all around the gas fuel duct 1, there is arranged a combustion air swirling device which is adapted for imparting to the combustion air a vortical motion. This combustion air swirling device consists of a set of inclined flat blades 15 arranged in circle in the annular conduit 10 and secured to an intermediate sleeve 16 which is fitted and secured on the gas fuel duct 1, as shown particularly in FIGS. 2 and 3. The outward side edges of the blades adhere against the inner surface of the tubular boss 3, and can be fixed thereto. If the burner is constructed for an operation with liquid fuels only, there is no gas fuel duct 1, and the intermediate sleeve 16 for the blades 15 of the combustion air swirling device can be tightly fitted and secured on the outer duct 12 of the liquid fuel lance 11.

The fire port 4 formed in the ceramic block 9 is composed of a rear, cylindrical portion 104 which is coaxial to the burner, i.e., to the tubular boss 3, to the gas fuel duct 1, and to lance 11 with the liquid fuel atomizing nozzle 14, and of a fore, flaring portion 204 which from the cylindrical portion 104 widens continuously towards its outlet region which is coplanar to the furnace crown or wall 17. Preferably however, according to one preferred embodiment of the invention, the flaring fore portion 204 of the burner fire port 4 is delimited by a surface of revolution around the burner axis. This surface of revolution has a profile in the form of a sector of a circle, extending, for example, over an angle of 90°, and to which the cylindrical rear portion 104 and the surface 17 of the furnace wall or crown are tangentially connected. In one particularly advantageous embodiment, the ratio between the parameters h, D, and R is the following:

$$h:D:R = 1:3 \text{ to } 5:7 \text{ to } 9$$

and preferably $$h:D:R = 1:4:8$$

D being the diameter of the cylindrical rear portion 104, h the length (for example from the front edge of the tubular boss 3) of this portion 104 in the direction of the burner axis, and R the radius of the profile shaped like a sector of a circle of the front portion 204 of the fire port 4.

Figure 4:
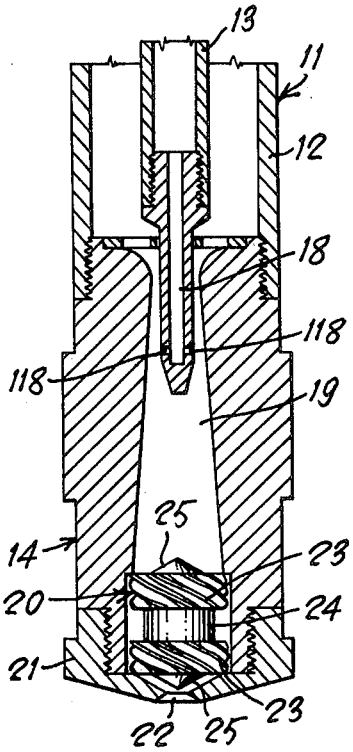
FIG. 4 shows in longitudinal section and in an enlarged scale the liquid fuel atomizing nozzle.
Figure 5:
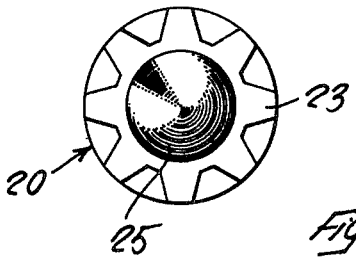
FIG. 5 is an axial view showing in an enlarged scale the helically grooved swirling device provided in the atomizing nozzle according to FIG. 4.

The liquid fuel atomizing nozzle 14 provided at the extremity of lance 11, may be constructed in various manners. In FIGS. 4 and 5 there is shown a particularly advantageous embodiment of said nozzle, which is especially adapted for heavy oil or masut, of which it guarantees a perfect, very fine preliminary nebulization by directing the small liquid fuel drops into the whirling combustion air stream flowing out of the annular conduit 10, while preventing the formation of any carbon deposits. This liquid fuel atomizing nozzle 14 substantially consists of an ejector with a liquid fuel outflow nozzle 18 connected to the end of the inner duct 13 of lance 11. This nozzle 18 extends coaxially into a convergent-divergent conduit 19 connected to the outer duct 12 of lance 11, and has a set of radial, liquid fuel outflow bores 118. Inside the end portion of the convergent-divergent conduit 19, a swirling device 20 is arranged. The swirling device 20 is held in place by a cap 21 which is screwed onto the end of the atomizing nozzle 14, and has a central bore 22 with a thin edge.

The device 20 which is incorporated in the liquid fuel atomizing nozzle 14, preferably consists of two cylindrical members 23 of small height, which are interconnected by means of a stem 24 whose diameter is less than that of the cylindrical members it connects. The cylinders 23 are each provided with a plurality of peripheral helical grooves opening into their respective top and bottom surfaces and preferably having a relatively small pitch. Both cylinders 23 terminate with a pointed conical head surface 25.

The auxiliary atomizing fluid (such as air, any suitable gas, steam, or the like) is fed under pressure through the outer duct 12 of lance 11 to the convergent-divergent conduit 19 in the liquid fuel atomizing nozzle 14. This atomizing fluid increases its rate of flow in the convergent and in the adjoined tapering portion of said conduit 19 and flows around the liquid fuel outflow nozzle 18, whereby it drives along the liquid fuel coming out from the radial bores 118 in nozzle 18, connected to the inner duct 13 of lance 11. The liquid fuel is thus finely atomized in the auxiliary atomizing fluid. At the end of the convergent-divergent conduit 19, the mixture of atomized liquid fuel and atomizing fluid passes through the helical grooves in the two cylinders 23 of the swirling device 20, whereby it picks up a whirling motion, preferably in the same direction as the vortical motion imparted to the combustion air by blades 15. The mixture of atomized liquid fuel and atomizing fluid finally flows out through the central bore 22 in cap 21 of the liquid fuel atomizing nozzle. In correspondence of said bore 22 the atomization of the liquid fuel is completed.

The jet of atomized liquid fuel streaming out of the atomizing nozzle 14 is per se a straight jet. However, owing to a phenomenon of aerodynamic instability, this jet fans out when it is injected in the middle of the whirling combustion air stream. This fanning out of the jet of atomized liquid fuel issuing from its atomizing nozzle 14 is at least in part due also to the axial position of the atomizing nozzle bore 22 inside the whirling combustion air stream. In this connection, particularly advantageous results are attained, according to the invention, when the nozzle 14 extends for 15 to 50 mm, preferably for 25 to 40 mm, beyond the blade arrangement 15 of the combustion air swirling device and/or beyond the edge of the tubular boss 3.

When the burner of the invention is operated with a liquid fuel, the said fanning out of the jet of atomized liquid fuel, and the tendency of the whirling combustion air stream to flow very close to the walls of the burner fire port 4, give rise to a uniform, regular and strong flame of the radiant or flat type, with a very favourable fuel distribution, whereby the best combustion is achieved, with no carbon deposits, and in any case with a very great flexibility in operation (useful adjustment ratio), quite profitable for industrial uses. Such an excellent performance of the burner is obtained also, and above all, when using heavy fuel oil as liquid fuel, with no risk of the atomizing nozzle becoming obstructed and/or damaged, and therefore without the need of a frequent servicing of said nozzle. The aforementioned advantages are attained with a very reduced pressure of combustion air, and therefore with a considerable saving in driving power, since the pressure energy of the atomizing fluid (air or steam) is partly used for producing the vortical motion required for the combustion. The advantages attained with the construction according to the invention are due to the particular combination of the whirling motions of the atomized liquid fuel and of the combustion air, in association with the described profile of the burner fire port and the perfect atomization of the liquid fuel.

Even when the burner is operated with gas fuel, supplied through duct 1, the particular construction of the burner fire port 4, possibly in combination with the combustion air swirling device, permits to attain a number of considerable advantages. In this case, with the construction according to the invention, a very intense combustion is obtained, so that the flame extends only up to the border of the flaring portion 204 of the burner fire port 4, or little beyond said border. In order to obtain such an intense combustion, very reduced combustion air and gas fuel pressures are used, as compared to those which were required up to now for this kind of burner, thus achieving a profitable economy, and also a lesser noise and a reduced formation of noxious combustion by-products.

Of course, the same above-stated advantages, or a combination of these advantages, is obtained also in the case of a mixed-feed operation of the burner, i.e., when this burner is simultaneously operated with liquid fuel, delivered and atomized by lance 11, and with gas fuel, supplied coaxially all around lance 11 through duct 1. On the other hand, as mentioned hereinabove, the invention is applicable also to burners running with liquid fuel only (by eliminating duct 1), or with gas fuel only (by eliminating lance 11).

From what above stated, it is apparent that the invention is not limited to the embodiment just described and shown in the drawings, but it is subject to variations and modifications particularly in the construction, without departing from the leading principle as above set forth and as claimed hereinafter.

We claim:

1. A radiant flat flame burner for liquid and/or gas fuels, comprising:

(a) at least two centrally-arranged nozzles, one for liquid fuel outflow and another for gas fuel, an atomizing nozzle for receiving the liquid fuel nozzle and forming a part of a lance, the lance comprising one duct for delivery of the liquid fuel to the liquid fuel nozzle, and a second duct for delivery of an atomizing fluid, each duct being connected to the atomizing nozzle which is at the extremity of the lance to atomize liquid fuel, characterized by the fact that the liquid fuel outflow nozzle, opens into a convergent-divergent conduit within said atomizing nozzle, which is connected to the duct for delivery of the atomizing fluid, the atomizing nozzle having incorporated therein a swirling device adapted to impart a whirling motion to the atomized liquid fuel, and (b) a coaxial combustion air annular conduit provided around the said centrally arranged nozzles and connected to a burner fire port delimited by refractory surfaces, characterized by the fact that the burner fire port has a rear cylindrical portion, with its rear end connected and coaxial with the combustion air conduit and with its front end having a flaring fore portion, widening out continuously towards its outlet end.

2. A burner according to claim 1, characterized by the fact that the swirling device consists of at least one fixed small-height cylindrical member with head ends, and the said cylindrial member is provided with a plurality of peripheral helical grooves opening on both head ends of the said cylindrical member.

3. A burner according to claim 2, characterized by the fact that the swirling device consists of two fixed cylindrical members provided with peripheral helical grooves, the members being in a coaxial, spaced apart relation, and being interconnected by means of a stem having a smaller diameter than the cylindrical members that it connects.

4. A burner according to claim 3, characterized by the fact that the opposite head ends of the helically grooved cylindrical members of the swirling device have a pointed conical shape.

5. A burner according to claim 2 wherein that the opposite head ends of the helically grooved cylindrical member of the swirling device have a pointed conical shape.

6. A radiant flat flame burner for liquid and/or gas fuels, comprising at least two centrally arranged nozzles, one for liquid fuel and another for gas fuel, with the nozzle for the liquid fuel being a lance, comprising at least one duct for delivery of an atomizing fluid, and at least one duct for delivery of the liquid fuel and which ducts are connected to an atomizing nozzle, provided at the extremity of the lance to atomize the liquid fuel, characterized by the fact that the liquid fuel outflow nozzle, connected to the liquid fuel delivery duct, opens into a convergent-divergent conduit connected to the duct for delivery of the atomizing fluid, the liquid fuel atomizing nozzle comprising a swirling device which is adapted for imparting to atomized liquid fuel a whirling motion, the swirling device consisting of two fixed cylindrical members provided with peripheral helical grooves, the members being set in a coaxial, spaced-apart relation and being interconnected by means of a stem having a smaller diameter than the cylindrical members that it connects, and also a coaxial combustion air annular conduit provided around said centrally arranged nozzles and connected to a burner fire port delimited by refractory surfaces, characterized by the fact that the burner fire port has a cylindrical portion with its rear end connected and coaxial with the combustion air conduit and with its front end having a flaring fore portion, widening out continuously to its outlet end.

7. A burner according to claim 6 within the two fixed cylindrical members have opposite head surfaces having a pointed conical shape.

8. A radiant flat flame burner for liquid and/or gas fuels comprising at least two centrally arranged nozzles, one for liquid fuel and the other for gas fuel, and also a coaxial combustion air annular conduit provided around said centrally arranged nozzles and connected to a burner fire port delimited by refractory surfaces, in which the burner fire port has a cylindrical portion with its rear end connected and coaxial with the combustion air conduit and with its front end having a flaring fore portion, widening out continuously towards its outlet end, the flaring fore portion of the burner fire port is delimited by a surface of revolution around the axis of the burner, with a profile in form of a sector of a circle, the profile in form of a sector of a circle of the fire port fore portion extends over an angle of 90 degrees, the ratio h:D:R between the axial length h of the rear cylindrical portion of the burner fire port, the diameter D of the said portion, and the radius R of the profile in the form of a sector of circle of the fire port fore portion, corresponds to 1:3 to 5:7 to 9, in the combustion air annular conduit a combustion air swirling device adapted for imparting to the combustion air a vertical motion, is provided arranged around the central nozzles for the gas and/or the liquid fuel, with a centrally arranged lance for delivering and atomizing the liquid fuel, comprising at least one duct for delivery of an atomizing fluid, and at least one duct for delivery of the liquid fuel, which ducts are connected to an atomizing nozzle provided at the extremity of the lance to atomize the liquid fuel, the liquid fuel outflow nozzle, connected to the liquid fuel delivery duct, opening into a convergent-divergent conduit connected to the duct for delivery of the atomizing fluid, the liquid fuel atomizing nozzle comprising a swirling device which is adapted for imparting to the atomized liquid fuel whirling motion, said swirling device consisting of at least one fixed small-height cylindrical member with head ends and the said cylindrical member is provided with a plurality of peripheral grooves opening on both head ends of the said cylindrical member.

9. A radiant flat flame burner for liquid and/or gas fuels, comprising at least two centrally arranged nozzles, one for liquid fuel outflow and one for gas fuel, and also a coaxial combustion air annular conduit provided around said centrally arranged nozzles and connected to a burner fire port delimited by refractory surfaces, characterized by the fact that the burner fire port has a cylindrical portion with its rear end connected and coaxial with the combustion air conduit and with its front end having a flaring fore portion, widening out continuously towards its outlet end, the flaring fore portion of the burner fire port is delimited by a surface of revolution around the axis of the burner, with a profile in the form of a sector of a circle, the profile in the form of a sector of a circle of the fire port fore portion extends over an angle of 90 degrees, the ratio h:D:R between the axial length h of the rear cylindrical portion of the burner fire port, the diameter D of the said portion, and the radius R of the profile in the form of a sector of a circle of the fire port fore portion, corresponds to 1:3 to 5:7 to 9, in the combustion air annular conduit a combustion air swirling device adapted for imparting to the combustion air a vertical motion, is provided arranged around the central nozzles for the gas and/or the liquid fuel, a centrally arranged lance for delivering liquid fuel, particularly heavy fuel oil, to an atomizing nozzle comprising at least one duct for delivery of an atomizing fluid, and at least one duct for delivery of the liquid fuel, which ducts are connected to the atomizing nozzle provided at the extremity of the lance to atomize the liquid fuel, characterized by the fact that the liquid fuel outflow nozzle, connected to the liquid fuel delivery duct, opens into a convergent-divergent conduit within said atomizing nozzle and connected to the duct for delivery of the atomizing fluid, which convergent-divergent conduit in the liquid fuel atomizing nozzle leads to the outside by means of a coaxial central bore with a thin edge located at the end of the liquid fuel atomizing nozzle.

10. A radiant flat flame burner for liquid and/or gas fuels, comprising:

(a) at least two centrally-arranged nozzles, one for liquid fuel and another for gas fuel, with the nozzle for the liquid fuel being a lance, comprising at least one duct for delivery of an atomizing fluid and at least one duct for delivery of the liquid fuel, each duct being connected to an atomizing nozzle provided at the extremity of the lance to atomize liquid fuel, characterized by the fact that a liquid fuel outflow nozzle, connected to the liquid fuel delivery duct, opens into a convergent-divergent conduit connected to the duct for delivery of the atomizing fluid, the convergent-divergent conduit in the liquid fuel atomizing nozzle leading to the outside by means of a coaxial central bore with a thin edge located at the end of the liquid fuel atomizing nozzle, and (b) a coaxial combustion air annular conduit provided around the said centrally arranged nozzles and connected to a burner fire port delimited by refractory surfaces, characterized by the fact that the burner fire port has a rear cylindrical portion, with its rear end connected and coaxial with the combustion air conduit and with its front end having a flaring fore portion, widening out continuously towards its outlet end.

* * * * *